US010672580B2

(12) United States Patent
Gazik et al.

(10) Patent No.: US 10,672,580 B2
(45) Date of Patent: Jun. 2, 2020

(54) SINGLE- OR MULTI-POLE POWER CIRCUIT-BREAKER AND MODULAR SYSTEM

(71) Applicant: Eaton Intelligent Power Limited, Dublin (IE)

(72) Inventors: Richard Gazik, Prague (CZ); Volker Heins, Rheinbach (DE)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/234,709

(22) Filed: Dec. 28, 2018

(65) Prior Publication Data

US 2019/0206650 A1 Jul. 4, 2019

(30) Foreign Application Priority Data

Dec. 29, 2017 (DE) ..... 10 2017 131 442

(51) Int. Cl.

| | |
|---|---|
| ***H01H 9/34*** | (2006.01) |
| ***H01H 77/02*** | (2006.01) |
| ***H01H 71/08*** | (2006.01) |
| ***H01H 71/12*** | (2006.01) |
| ***H01H 71/10*** | (2006.01) |

(Continued)

(52) U.S. Cl.

CPC ..... *H01H 83/20* (2013.01); *H01H 71/08* (2013.01); *H01H 71/12* (2013.01); *H01H 71/2472* (2013.01); *H01H 77/02* (2013.01); *H01H 9/342* (2013.01); *H01H 71/1081* (2013.01);

(Continued)

(58) Field of Classification Search

CPC .... H01H 71/08; H01H 71/12; H01H 71/2472; H01H 73/00; H01H 73/10; H01H 9/342; H01H 2077/025; H01H 83/20

USPC ..... 218/149, 34, 81, 134, 139, 155, 156; 335/6

See application file for complete search history.

(56) References Cited

U.S. PATENT DOCUMENTS

| | | | |
|---|---|---|---|
| 3,631,369 | A | 12/1971 | Menocal |
| 5,103,198 | A | 4/1992 | Morel et al. |

(Continued)

FOREIGN PATENT DOCUMENTS

| | | | |
|---|---|---|---|
| DE | 69110540 | T2 | 2/1996 |
| DE | 20214922 | U1 | 11/2002 |
| WO | WO 0169630 | A1 | 9/2001 |

*Primary Examiner* — William A Bolton

(74) *Attorney, Agent, or Firm* — Leydig, Voit & Mayer, Ltd.

(57) ABSTRACT

A single- or multi-pole power circuit-breaker, comprises main contacts, overload- and/or short-circuit current-actuated tripping means, an actuating mechanism for the main contacts, an arc chute and a pressure trip unit having a return element and an actuating element responsive to an overpressure in the arc chute. The tripping of the power circuit-breaker by a trip mechanism is executable both by the tripping means and the pressure trip unit. The pressure trip unit is arranged immediately adjacently to both the arc chute and a main busbar. A tripping lug mechanically engages with the trip mechanism such that an overpressure in the arc chute is transmitted virtually instantaneously to the pressure chamber. The actuating element is configured to switch over directly from a home position to a tripping position, against the force of the return element, in a case of overshoot of a pressure threshold value set by the return element.

14 Claims, 6 Drawing Sheets

(51) Int. Cl.
*H01H 71/24* (2006.01)
*H01H 83/20* (2006.01)

(52) U.S. Cl.
CPC ..... *H01H 2071/2427* (2013.01); *H01H 2077/025* (2013.01); *H01H 2083/201* (2013.01)

(56) References Cited

U.S. PATENT DOCUMENTS

| | | | | |
|---|---|---|---|---|
| 5,731,561 | A * | 3/1998 | Manthe | H01H 9/34 218/157 |
| 6,281,458 | B1 * | 8/2001 | Castonguay | H01H 1/2058 218/22 |
| 6,542,057 | B2 * | 4/2003 | Douville | H01H 77/02 218/155 |
| 8,063,334 | B2 * | 11/2011 | Dahl | H01H 9/342 218/114 |
| 8,553,385 | B2 * | 10/2013 | Ahlert | H01H 71/12 361/102 |
| 8,947,182 | B2 | 2/2015 | Ahlert et al. | |
| 2002/0130744 | A1 * | 9/2002 | Jodehl | H01H 77/10 335/172 |
| 2013/0140275 | A1 * | 6/2013 | Shea | H01H 9/342 218/149 |
| 2015/0200066 | A1 | 7/2015 | Legendre et al. | |

* cited by examiner

SINGLE- OR MULTI-POLE POWER CIRCUIT-BREAKER AND MODULAR SYSTEM

CROSS-REFERENCE TO PRIOR APPLICATION

Priority is claimed to German Patent Application No. DE 10 2017 131 442.3, filed on Dec. 29, 2017, the entire disclosure of which is hereby incorporated by reference herein.

FIELD

The present invention relates to a single- or multi-pole power circuit-breaker comprising, for each pole, main contacts, overload- and/or short-circuit current-actuated tripping means, an actuating mechanism for the opening and closing of the main contacts, an arc chute and a pressure trip unit. The invention further relates to a modular system comprising such a power circuit-breaker and instantaneous electromagnetic short-circuit trip devices.

BACKGROUND

Power circuit-breakers are employed in electricity distribution networks for the protection of down-circuit installations against damage associated with an overload or short-circuit. To this end, power circuit-breakers incorporate electromagnetic, thermal or electronic tripping means which, upon the overshoot of a predetermined current value, e.g. in the event of an overload or a short-circuit, trigger an actuating mechanism which, in turn, executes the opening of the power circuit-breaker. A power circuit-breaker thus tripped interrupts the supply of electricity to down-circuit components in the electricity network, thereby protecting the latter against damage associated with high overload and/or short-circuit currents.

In many cases, in widely-ramified electricity distribution networks, a plurality of series-connected power circuit-breakers are selectively employed in a staggered manner. By this, it is understood that, in the event of a fault, for example a short-circuit, only the load-adjacent power circuit-breaker which is closest to a load is tripped in the first instance, whereas a load-distant power circuit-breaker, which is superordinate in the electricity distribution network hierarchy to the load-adjacent power circuit-breaker, is not tripped. In other words, in the event of a fault, only the power circuit-breaker which is closest to the incident interrupts the flow of current. In this manner, the supply of current to other parts of the electricity distribution network, which are not directly affected by the fault, can be maintained. Power circuit-breakers which operate in this selective manner are also described as selective power circuit-breakers. Selectivity is achieved, in that the load-distant power circuit-breaker is tripped with a time delay in relation to the load-adjacent power circuit-breaker. Such a time delay can be set, for example, electronically or mechanically.

Delayed opening of this type can be problematic in the case of very high short-circuit currents on the grounds that, as a result of the predetermined time delay, the selective power circuit-breaker will not trip until the magnitude of the short-circuit current has already resulted in the direct damage, or even the destruction of the power circuit-breaker itself. In the event of very high currents, the electromagnetic effects of the currents flowing in the switching contacts are so great that the switching contacts of the power circuit-breaker, as a result of electromagnetic repulsion, are subject to short-term mutual disengagement. This results in the generation of an arc between the opened switching contacts. Such arcs have a high destructive force, and can cause permanent damage to a power circuit-breaker and the reduction of its service life. Given that, in a selective power circuit-breaker, direct opening is not desired in the first instance, the switching contacts reclose after a short-term disengagement of the contacts. Further arcing is generated as a result. In this case, the self-protection function of the power circuit-breaker is thus eliminated, as a result of the predetermined time delay.

In order to circumvent the predetermined time delay in selective power circuit-breakers in the event of very high short-circuit currents, various measures have already been implemented.

DE 202 14 922 U1 thus discloses a power circuit-breaker with instantaneous short-circuit trip devices, wherein the instantaneous short-circuit trip devices comprise hinged armatures which, in the event of high short-circuit currents due to electromagnetic effects, execute a rotating motion against the force of a spring element, as a result of which the actuating mechanism of the power circuit-breaker is tripped and the switching contacts of the power circuit-breaker are fully opened. By means of the specific configuration of the spring element, the response behaviour of the instantaneous short-circuit trip devices can thus be influenced such that the hinged armatures only break away upon the overshoot of a short-circuit current of a predetermined magnitude. As a result of the special geometry of the hinged armatures, the instantaneous short-circuit trip devices only respond beyond the trip threshold of the normal short-circuit tripping means which are present on the power circuit-breaker, but significantly more rapidly than the latter.

Moreover, the exploitation of the pressure increase associated with the generation of an arc in selective power circuit-breakers is also already known. In the interests of the most rapid quenching possible, arcs in a power circuit-breaker are conducted by appropriate means to an arc chute, and are quenched therein. As a result of the high energy of the arc, this is associated with an extremely rapid pressure increase in the arc chute. This pressure increase can be exploited with respect to the selectivity and the simultaneous self-protection of power circuit-breakers.

Thus, for example, DE 691 10 540 T2 describes a selective power circuit-breaker with a pressure trip unit. To this end, the trip unit of the power circuit-breaker, in addition to an overload and/or short-circuit capture element which, in the event of a fault, delivers a signal to a switching mechanism for the automatic opening of the power circuit-breaker, comprises an actuating element which responds to a pressure increase in a separation zone of the switching contacts associated with the generation of an arc, and actuates the opening mechanism. The actuating element comprises a moving component, for example a piston, which is exposed, firstly to the overpressure generated in the arc chute, via a connection line which is arranged between the pressure trip unit and the arc chute, and secondly to an appropriate effective force delivered by a return device, for example a return spring. A displacement of the piston against the force of the return spring thus initiates the tripping of the opening mechanism of the power circuit-breaker, wherein the return device is adjusted such that any spurious tripping in response to a simple overload is prevented.

In other words, the power circuit-breaker described in DE 691 10 540 T2, additionally to the trip mechanism which is customarily provided, incorporates an actuating element which responds to an overpressure in the arc chute, wherein a pressure threshold can be set by means of a return device such that the actuating element, upon the occurrence of an arc with a very high current, responds very rapidly and actuates a rapid tripping of the power circuit-breaker whereas, for the disconnection of a normal or small current, it shows practically no response, as the overpressure generated in the arc chute is not sufficient to overcome the force of the return device. In this manner, a circuit-breaker is provided which can be employed selectively, but which simultaneously incorporates a self-protection function in the event of very high currents.

The above-mentioned power circuit-breaker has a disadvantage in that, in a three-pole power circuit-breaker, the three poles are respectively connected by means of ducts to a collection chamber, which in turn incorporates a connection to the pressure chamber of the overpressure actuating element. The individual ducts, in the region of their entry to the collection chamber, are provided with non-return values, in order to prevent any flow of gas from one pole to another. Accordingly, the overpressure generated in one pole must firstly be propagated through the duct system before it can act on the actuating element in the pressure chamber. As the overpressure actuating element is arranged at some distance from the arc chute, this can result in both a pressure loss and a time delay within the duct system, with a respective negative impact upon the response behaviour of the actuating element. The system is moreover comprised of a plurality of individual components, thereby resulting in a pressure tripping system of complex design, which is susceptible to wear.

From U.S. Pat. Nos. 8,947,182 B2, 3,631,369, US 2015/0200066 A1 and WO 01/69630 respectively, selective trip devices are also known, having overpressure-responsive actuating elements. In this case, however, the respective actuating element is arranged in a flow duct of the circuit-breaker which functions as an exhaust duct. Via this exhaust duct, gas which is generated in conjunction with the ignition of an arc is discharged from the arc chute. In order to fulfil this function, the exhaust duct must remain open, and the forces acting on the actuating element arranged in the exhaust duct must be generated exclusively by the prevailing flux in the exhaust duct, which is perceived as disadvantageous. Moreover, an open system of this type is highly susceptible to fouling, as the pressure trip unit is directly exposed to the gases leaving the arc chute.

SUMMARY

In an embodiment, the present invention provides a single- or multi-pole power circuit-breaker, which comprises, for each pole, main contacts, overload- and/or short-circuit current-actuated tripping means, an actuating mechanism configured to open and close the main contacts, an arc chute and a pressure trip unit having a return element and an actuating element responsive to an overpressure in the arc chute. The tripping of the power circuit-breaker by a trip mechanism is executable both by the tripping means and by the pressure trip unit. The pressure trip unit is arranged immediately adjacently to both the arc chute and to a main busbar which is routed to the respective main contacts, and is arranged within a closed pressure chamber which is connected to the arc chute. At least one tripping lug which projects from the actuating element is configured to mechanically engage with the trip mechanism such that an overpressure in the arc chute associated with the generation of an arc between the main contacts is transmitted virtually instantaneously to the pressure chamber, where the overpressure acts on the actuating element of the pressure trip unit. The actuating element is configured to switch over directly from a home position to a tripping position, against the force of the return element, in a case of overshoot of a pressure threshold value which is set by the return element.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
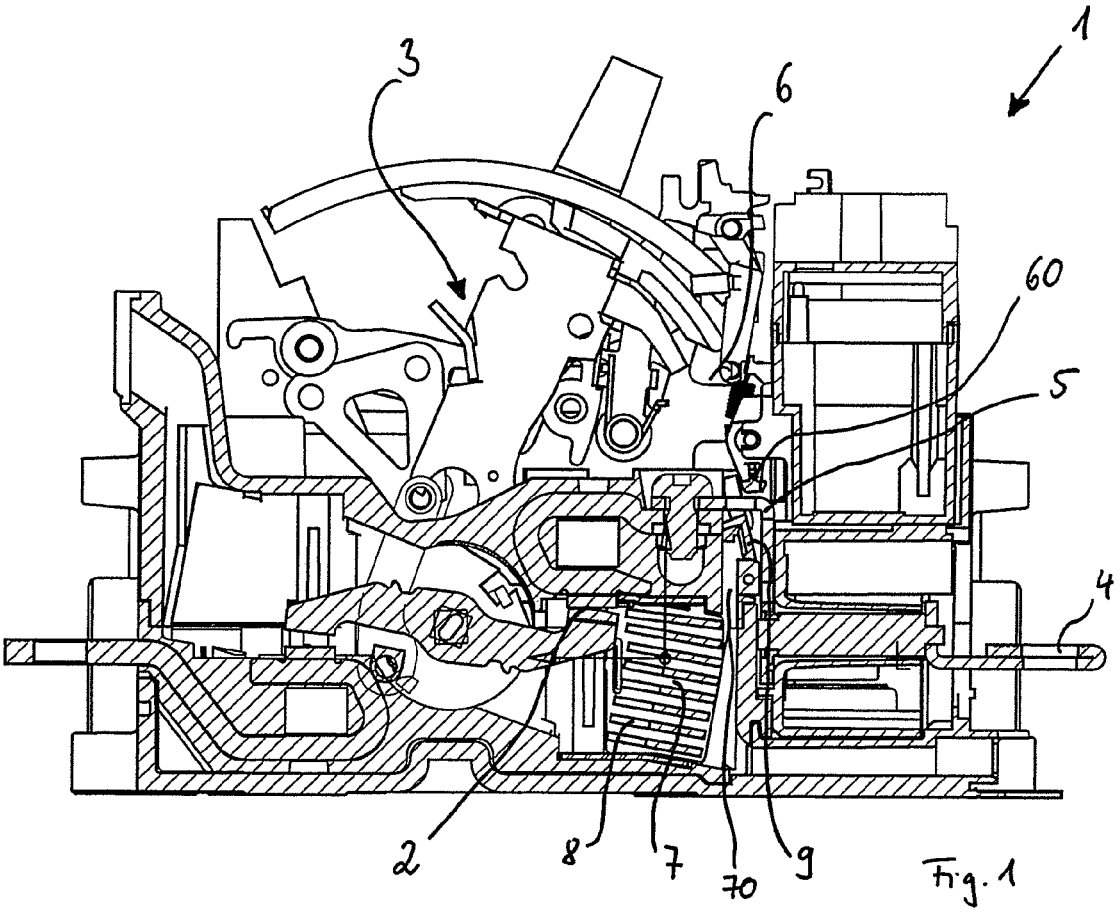
FIG. 1: shows a longitudinal section of a first form of embodiment of a power circuit-breaker according to the invention.

In an embodiment, the present invention provides a power circuit-breaker which overcomes the above-mentioned disadvantages of the prior art, in a structurally simple manner, and which can specifically be employed as a selective power circuit-breaker. In another embodiment, the invention provides a modular system comprising a power circuit-breaker, which can be adapted to different requirements in a simple manner.

According to an embodiment, the invention provides a single- or multi-pole power circuit-breaker comprising, for each pole, main contacts, overload- and/or short-circuit current-actuated tripping means, an actuating mechanism for the opening and closing of the main contacts, an arc chute and a pressure trip unit, wherein the tripping of the power circuit-breaker by a trip mechanism can be executed both by the tripping means and by the pressure trip unit, wherein the pressure trip unit further comprises an actuating element which responds to an overpressure in the arc chute, and a return element. The power circuit-breaker according to the invention is characterized in that the pressure trip unit is arranged immediately adjacently to both the arc chute and to a main busbar which is routed to the respective main contact, and is arranged within a closed pressure chamber which is connected to the arc chute, wherein at least one trip lug which projects from the actuating element mechanically engages with the trip mechanism, such that an overpressure in the arc chute associated with the generation of an arc between the main contacts is transmitted virtually instantaneously to the pressure chamber, where it acts on the actuating element of the pressure trip unit and, upon the overshoot of a pressure threshold value which is set by means of the return element, the actuating element is switched over directly from a home position to a tripping position, against the force of the return element.

In other words, in comparison with known solutions, the power circuit-breaker according to an embodiment of the invention has the advantage that the pressure trip unit is arranged directly adjacently to the arc chute. For this reason, a connection line routed through the power circuit-breaker between the arc chute and the pressure trip unit can be omitted. A connection line of this type results in a time delay between the pressure build-up in the arc chute and the action of the overpressure thus generated on the actuating element of the pressure trip unit, as the overpressure must firstly be propagated from the arc chute to the pressure trip unit via the connection line. In addition to a time delay, the transmission of pressure via a connection line can also be associated with pressure losses such that, under certain circumstances, the pressure acting on the actuating element of the pressure trip unit is reduced in relation to the pressure originally generated in the arc chute. These disadvantages are eliminated by the arrangement of the pressure trip unit immediately adjacently to the arc chute, in accordance with an embodiment of the invention. The overpressure generated in the arc chute thus acts virtually instantaneously on the actuating element of the pressure trip unit, with no pressure and/or time losses associated with a connection line. Thus, in comparison with known solutions, a more accurate and more rapid response of the pressure trip unit is ensured.

Moreover, according to an embodiment of the invention, as each pole of the power circuit-breaker comprises a pressure trip unit with a separate actuating element, it is not necessary, as is known from the prior art, to provide a collection chamber, with non-return valves on the ducts which are connected thereto. The design of the pressure trip system can thus be significantly simplified, and the number of individual components required reduced.

However, according to an embodiment of, the pressure trip unit of the power circuit-breaker is not only arranged directly adjacently to the arc chute, but is also arranged directly adjacently to a main busbar which is routed to the respective main contact. Thus, at least one of the tripping lugs which projects from the actuating element of the pressure trip unit mechanically engages with the trip mechanism. The at least one tripping lug, for example, can thus be routed through a guide slot in the main busbar wherein, alternatively or additionally, one or more, preferably two tripping lugs can also be routed laterally to the main busbar. The overpressure associated with the generation of an arc in the arc chute thus acts virtually instantaneously on the actuating element of the pressure trip unit, as a result of which the latter, provided that the overpressure exceeds a predetermined threshold value, is switched over directly from a home position to a tripping position, against the force of the return element. Upon the transition from the home position to the tripping position, the movement of the at least one tripping lug of the actuating element initiates a tripping of the power circuit-breaker, by means of the tripping mechanism. For example, a free end of the at least one tripping lug cooperates with a free end of a tripping rod which is associated with the tripping mechanism, such that a movement of the at least one tripping lug initiates a rotating movement of the tripping rod, and thus tripping of the power circuit-breaker, which is described in greater detail hereinafter.

Finally, in the power circuit-breaker according to an embodiment of the invention, the pressure trip unit is arranged within a closed pressure chamber which is connected to the arc chute. Within the meaning of the invention, a closed pressure chamber is to be understood as a space which is open with respect to the arc chute, but is otherwise substantially sealed, into which the overpressure generated in the arc chute can be propagated in a substantially loss-free manner. In this manner, a sufficient pressure build-up within the pressure chamber can be ensured. The pressure chamber is designed such that the leak-tightness of the pressure chamber is also maintained over the entire motion path of the actuating element, from the home position to the tripping position. To this end, for example, corresponding sealing elements can be provided in the pressure chamber. These sealing elements can be configured as separate components, or as integrally-configured components on the power circuit-breaker. From the term "substantially sealed", it can be inferred that small gaps remain between the stationary components and the movable actuating element, which are ultimately necessary in order to permit the movement of the actuating element. Specifically, however, a closed pressure chamber of this type is not an exhaust duct of the power circuit-breaker which, on the grounds of its function, must be permanently provided with an opening to the external environment of the power circuit-breaker.

By means of the arrangement of the pressure trip unit in the above-mentioned manner, it is specifically possible to configure the power circuit-breaker according to an embodiment of the invention with an identical structural design to that cited in the above-mentioned DE 202 14 922 U1. The power circuit-breaker according to DE 202 14 922 U1 comprises instantaneous short-circuit trip devices, which are electromagnetically coupled to a respective main busbar. The pressure trip units described in the context of an embodiment of the present invention, alternatively to the instantaneous short-circuit trip devices disclosed in DE 202 14 922 U1, can be installed in the power circuit-breaker in the same location as the latter. They occupy the same space and employ the same interfaces, such that the trip mechanism can be actuated by both types of trip devices in an identical manner. The power circuit-breaker according to an embodiment of the invention can thus be incorporated as part of a modular system in which, on the basis of a power circuit-breaker of consistent basic design, as a result of the special arrangement of the pressure trip unit provided according to an embodiment of the invention, the latter can be replaced with known instantaneous short-circuit trip devices in the simplest possible manner.

Power circuit-breakers with electromagnetically-actuated instantaneous short-circuit trip devices, in response to a magnetic field which is constituted directly in conjunction with the rising current in the main busbar, already respond at currents of the order of 3,000 to 4,000 amperes, whereas a power circuit-breaker with a pressure trip unit, in general, will only respond at currents in excess of approximately 5,000 amperes. Thus, according to the trip mechanism selected, different selectivity thresholds for the power circuit-breaker can be achieved, thus allowing different market requirements to be taken into account. As a result of the above-mentioned simple conversion capability of the power circuit-breaker according to an embodiment of the invention, a power-circuit breaker of consistent basic design, by means of minor modifications, can be converted from an embodiment with pressure trip units to an embodiment with instantaneous short-circuit trip devices, and vice versa.

According to one embodiment of the invention, the actuating element is configured as a gate which is arranged to pivot about a pivoting axis. It can be provided that the gate, in the home position, under the influence of the return element, is pivoted away from the main busbar and, upon the overshoot of the pressure threshold value, against the force of the return element, is pivoted out of the home position towards the main busbar. A pivoting gate of this type can essentially be of identical design to the hinged armature in the above-mentioned instantaneous short-circuit trip device from DE 202 14 922 U1, wherein an appropriate plastic material is preferably employed as the material for the gate.

As a result of the arrangement of the pressure trip unit incorporating a pivoting gate in direct proximity to the arc chute and within a closed pressure chamber which is connected to the arc chute, the gate is virtually instantaneously exposed to the overpressure which is generated in the arc chute and, as soon as a predefined pressure threshold value is exceeded, is pivoted towards the main busbar. The pressure chamber is configured such that leak-tightness thereof is maintained over the entire motion path of the gate. The at least one tripping lug which projects from the gate, for example, through a guide slot in the main busbar, mechanically engages with the trip mechanism of the power circuit-breaker, such that a pivoting of the gate towards the main busbar, i.e. into the tripping position, in response to the application of pressure, effects the tripping of the power circuit-breaker.

In an exemplary embodiment of the invention, it can be provided that the gate incorporates laterally-projecting shielding elements which, with the pressure trip unit in the service position, at least partially cover the return element. By this arrangement, it can be prevented that hot gases originating from the arc chute act directly on the return element, resulting in the impairment or damage of the latter.

According to a further embodiment of the invention, at least one sealing element is arranged in the pressure chamber, wherein the gate, upon the transition from the home position to the tripping position, is permanently sealed with respect to the at least one sealing element. The at least one sealing element can be configured as a separate component, or as an integrally-formed component on the power circuit-breaker. Specifically, a projection can be configured on the gate which, upon the transition of the gate from the home position to the tripping position, moves along a circular outline of a sealing element, and remains in an overlapping arrangement with the latter. By means of a circular outline on the sealing element, the movement of the projection along a circular path during the rotating motion of the gate is taken into account. By means of the projection, the gate is thus sealed over its entire motion path with respect to the sealing element. In a region adjoining the pivoting axis, the gate can likewise move along a circular outline of a sealing element such that, here again, a seal is maintained over the entire motion path of the gate, and no unwanted pressure drop occurs in the pressure chamber.

According to an alternative embodiment of the invention, the actuating element is configured as a linearly movable piston. In this configuration, the pressure trip unit can comprise a housing, in which the piston is accommodated, wherein a base of the housing which faces the arc chute incorporates at least one opening, through which the overpressure which is generated in the arc chute is propagated into the housing, and acts on the piston. In other words, in this configuration of the invention, the overpressure generated in the arc chute, through the at least one opening in the base of the housing which, in turn, is arranged in direct proximity to the arc chute, also acts virtually instantaneously on the piston, such that the latter, upon the overshoot of a predetermined pressure threshold value, executes a direct transition from its home position to a tripping position. The motion of the piston is a linear motion, guided by the housing and contrary to the force of the return element. The housing, including the piston which is substantially arranged within the housing, occupies the same space within the power circuit-breaker as the gate described with reference to the above-mentioned exemplary embodiment. Specifically, both the pivoting gate and the housing with a linearly movable piston occupy the same space as the electromagnetic hinged armature disclosed in DE 202 14 922 U1.

Through a guide slot in the main busbar, a tripping lug which projects from the piston mechanically engages with the trip mechanism of the power circuit-breaker such that, upon the application of pressure, the linear motion of the piston from the home position to the tripping position initiates a trip of the power circuit-breaker. For example, a free end of the tripping lug cooperates with a free end of a tripping rod which is associated with the tripping mechanism, such that a movement of the tripping lug which is associated with the motion of the piston initiates a rotary motion of the tripping rod, and thus a tripping of the power circuit-breaker.

It can provided that the tripping lug, which projects from the piston and mechanically engages with the trip mechanism through the guide slot in the main busbar, at the free end thereof which projects through the guide slot, is tapered such that a linear motion of the piston initiates a rotary motion of tripping rod which is associated with the trip mechanism and which cooperates with the free end of the tripping lug.

As a return element according to the invention, in all the configurations of the invention, at least one spring can be provided. By the selection of the spring constant of the at least one spring, a pressure threshold value can be set. In other words, the actuating element, upon the application thereto of an overpressure which lies below the pressure threshold value, is maintained in its home position by the force of the at least one spring, whereas the actuating element, upon the application thereto of an overpressure which exceeds the pressure threshold value, executes a direct transition from its home position to the tripping position, overcoming the force of the at least one spring.

In addition to its facility for the setting of a pressure threshold value, the return element, specifically the at least one spring, further executes a reset function, i.e. further to the tripping of the power circuit-breaker, the actuating element, by means of the force exerted by the return element, moves from the tripping position back to its home position, such that the pressure trip unit is available for further operation.

In the configuration of the actuating element as a pivoting gate, the spring can be configured, for example, as a double torsion spring, which can be positioned by means of bearing slots which are provided on the main busbar and on the pivoting gate. Moreover, locating pins are configured on the gate, to which the windings of the torsion spring can be fitted.

In the configuration of the actuating element as a linearly movable piston, the at least one spring can be configured as a helical compression spring, one end of which cooperates with the piston, and the second end of which, for example, is braced against the housing or the main busbar.

According to an embodiment, the invention provides a modular system, comprising a single- or multi-pole power circuit-breaker according to an embodiment of the invention and instantaneous electromagnetic short-circuit trip devices, wherein, for each pole of the power circuit-breaker, the pressure trip unit is interchangeable with an instantaneous electromagnetic short-circuit trip device which occupies the same space and employs the same interfaces. A modular system of this type provides a high degree of flexibility in that, using a power circuit-breaker of consistent basic design, and depending upon the field of application, an interchange can be executed between pressure trip units and instantaneous electromagnetic short-circuit trip devices, thus permitting the achievement of different selectivity thresholds. The conversion from pressure trip units to instantaneous electromagnetic short-circuit trip devices and vice versa can be executed in the simplest manner, as both types of trip devices occupy the same space within the power circuit-breaker and employ the same interfaces. Instantaneous electromagnetic short-circuit trip devices are preferably instantaneous electromagnetic short-circuit trip devices of the type described in DE 202 14 922 U1.

Specifically, for both a pressure trip unit and an instantaneous short-circuit trip device, a tripping rod of identical design, associated with the trip mechanism, can be employed.

In the embodiment of the actuating element as a pivoting gate, for both a pressure trip unit and an instantaneous short-circuit trip device, the same return element, specifically the same double torsion spring, can be employed. Moreover, the gate of the pressure trip unit and a magnetic armature of the instantaneous electromagnetic short-circuit trip device can essentially comprise one and the same angle of rotation and occupy essentially one and the same position within the power circuit-breaker. Finally, the tripping lug configured on the gate and a tripping lug configured on a magnetic armature of an instantaneous short-circuit trip device can be of identical design such that, upon the rotary motion of the gate or the magnetic armature, a load is applied to the tripping rod associated with the trip mechanism in the same manner.

A modular system of this type thus provides a high degree of flexibility, while simultaneously featuring a very small number of components which require adaptation.

FIG. 1 shows an overall view of a three-pole power circuit-breaker according to an embodiment of the invention, designated as 1, wherein the representation in FIG. 1 shows a longitudinal section of one pole of the power circuit-breaker 1. However, all the statements regarding this pole of the power circuit-breaker 1 also apply correspondingly to the two further poles of the power circuit-breaker 1.

The power circuit-breaker 1, for the pole represented, comprises main contacts 2, which can be opened or closed by means of an actuating mechanism 3 in a known manner. Between the main terminal 4 and the main contacts 2, a main busbar 5 is arranged. In order to protect an installation in an electricity distribution network which is arranged downcircuit of the power circuit-breaker 1 against overload and/or short-circuit currents, the power circuit-breaker 1 is equipped with electronic tripping means, which are not represented in greater detail in FIG. 1. These process load currents which are detected by electromagnetic instrument transformers and transmitted via the main busbar 5 and, in the event of a fault, cause the excitation of a trip magnet which, in turn, trips the actuating mechanism 3 by means of a trip mechanism 6, thereby resulting in the opening of the main contacts 2.

FIG. 1 further represents an arc chute 7, incorporating arc splitters 8 which de-ionize and cool the arcs which are generated between the latter upon the opening of the main contacts 2. Additionally to the above-mentioned tripping means, the pole of the power circuit-breaker 1 represented further comprises a pressure trip unit 9, which is arranged immediately adjacently to the arc chute 7 and within a closed pressure chamber 70 which is connected to the arc chute 7, and incorporates an actuating element which responds to an overpressure in the arc chute 7.

Figure 2:
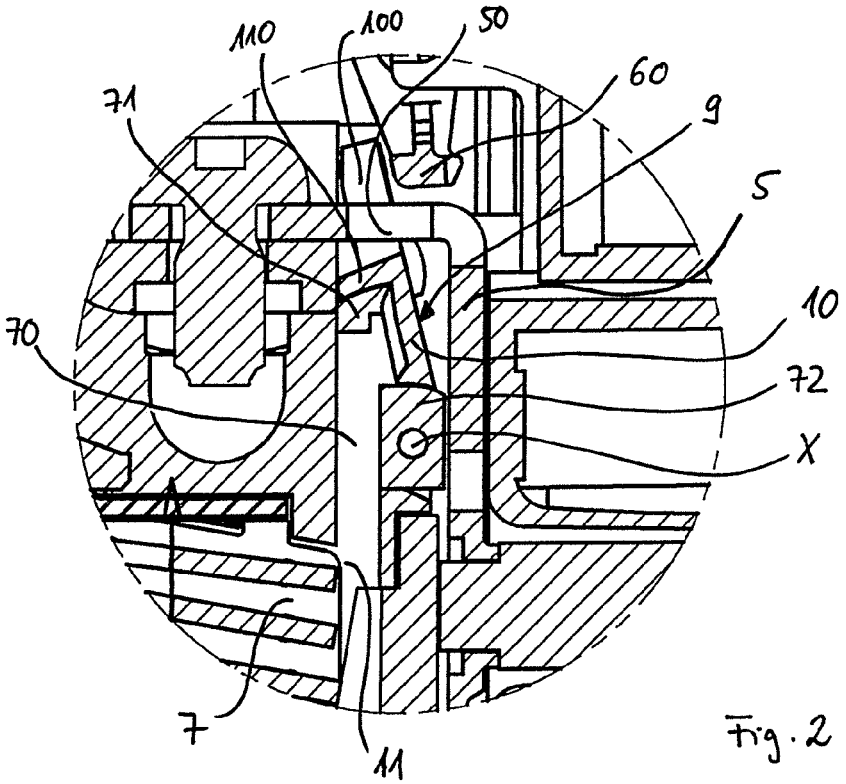
FIG. 2: shows an enlarged representation of a section of FIG. 1, with the actuating element in the home position.
Figure 3:
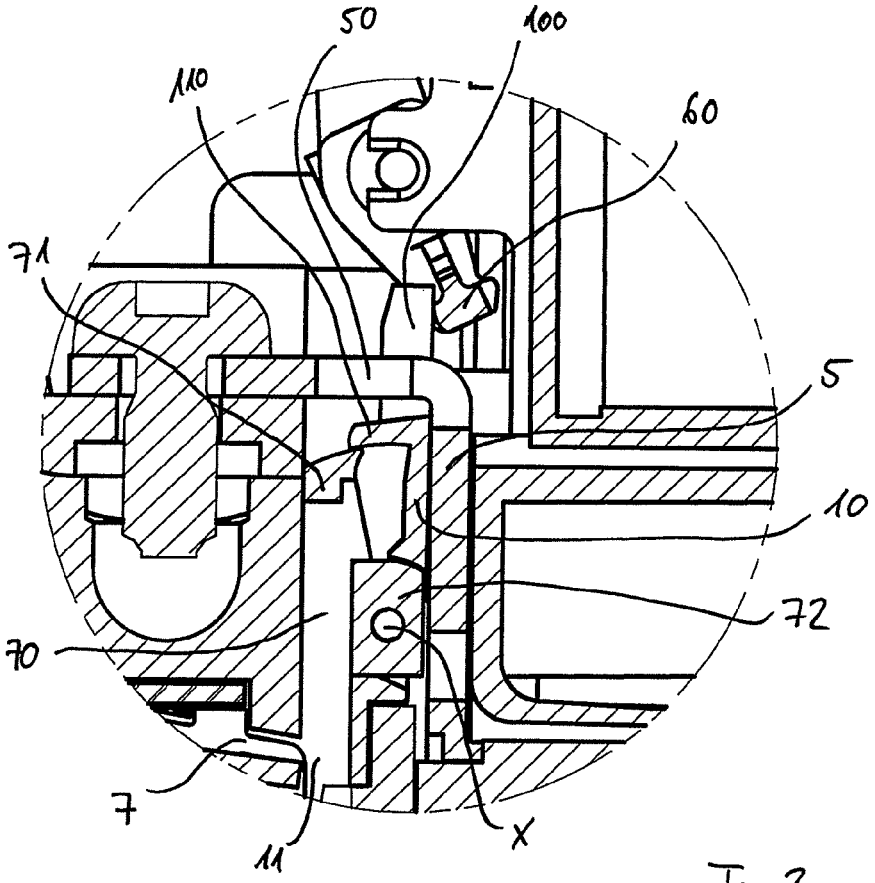
FIG. 3: shows an enlarged representation of a section of FIG. 1, with the actuating element in the tripping position.

The mode of operation of the pressure trip unit 9 is clarified by the detailed representations in FIGS. 2 and 3. Herein, the actuating element is configured as a pivoting gate 10 which is arranged to pivot about a pivoting axis X, wherein FIG. 2 represents the gate 10 in the home position, whereas FIG. 3 represents the gate 10 in the tripping position. The gate 10 is formed of a plastic, and is arranged within the closed pressure chamber 70 which, in turn, by means of an opening 11, is directly connected to the arc chute 7. An overpressure which is generated in the arc chute 7 by the ignition of an arc between the main contacts 2 is thus propagated through the opening 11 directly in the direction of the gate 10. The overpressure is applied to the gate 10 and, by means of the former, provided that a predetermined pressure threshold value is exceeded, executes a transition by a clockwise rotary motion from the home position represented in FIG. 2 to the tripping position represented in FIG. 3. In the tripping position represented in FIG. 3, the gate 10 cooperates with an essentially vertically downwardly-extending section of the main busbar 5. Setting of the pressure threshold value is achieved is achieved by means of a return element configured as a double torsion spring 32, which cannot be seen in FIGS. 1 to 3, but which will be further described in greater detail hereinafter with reference to FIGS. 4 to 7.

Stationary sealing elements 71, 72 are arranged within the pressure chamber 70, which ensure that the leak-tightness of the pressure chamber 70 is maintained over the entire motion path of the gate 10 from the home position to the tripping position, such that no unwanted pressure drops occur within the pressure chamber 70. On the gate 10, a projection 110 is configured which, upon the transition of the gate 10 from the home position to the tripping position, moves along the circular outline of the sealing element 71, but is maintained in a consistently overlapping arrangement with the latter, c.f. FIG. 3, such that the gate 10 is permanently sealed with respect to the sealing element 71. The same applies to the contact between the lower region of the gate 10 and the sealing element 72.

Figure 4:
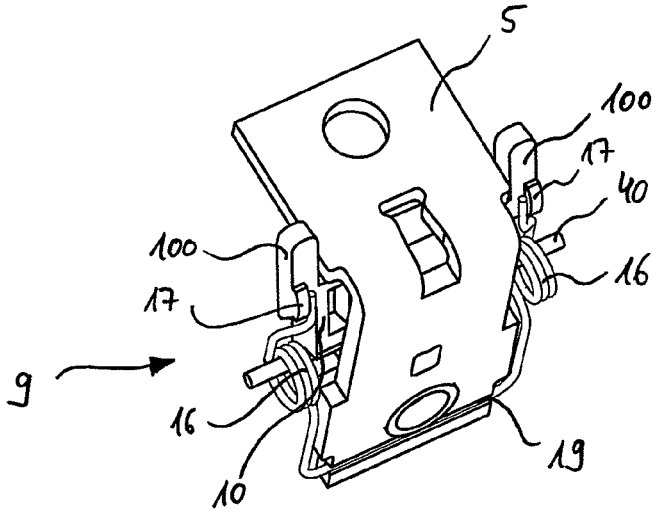
FIG. 4: shows a perspective view of the pressure trip unit arranged on a main busbar, according to the first form of embodiment.

The gate 10 is arranged directly adjacently to the main busbar 5, wherein the gate 10 comprises two tripping lugs 100, of which only one can be seen in the representation shown in FIGS. 2 and 3. The tripping lugs 100 are each routed laterally to the main busbar 5, c.f. FIG. 4. The tripping lugs 100 mechanically engage with the trip mechanism 6, such that a free end of the tripping lugs 100 cooperates with a tripping rod 60 which is associated with the trip mechanism 6. As a result of the rotary motion of the gate 10 from the home position to the tripping position, in the above-mentioned manner, by the application of pressure, the tripping lugs 100 in turn apply a load to the tripping rod 60 of the trip mechanism 6. A swiveling of the tripping rod 60 which is initiated in this manner results directly in the tripping of the power circuit-breaker 1.

Figure 5:
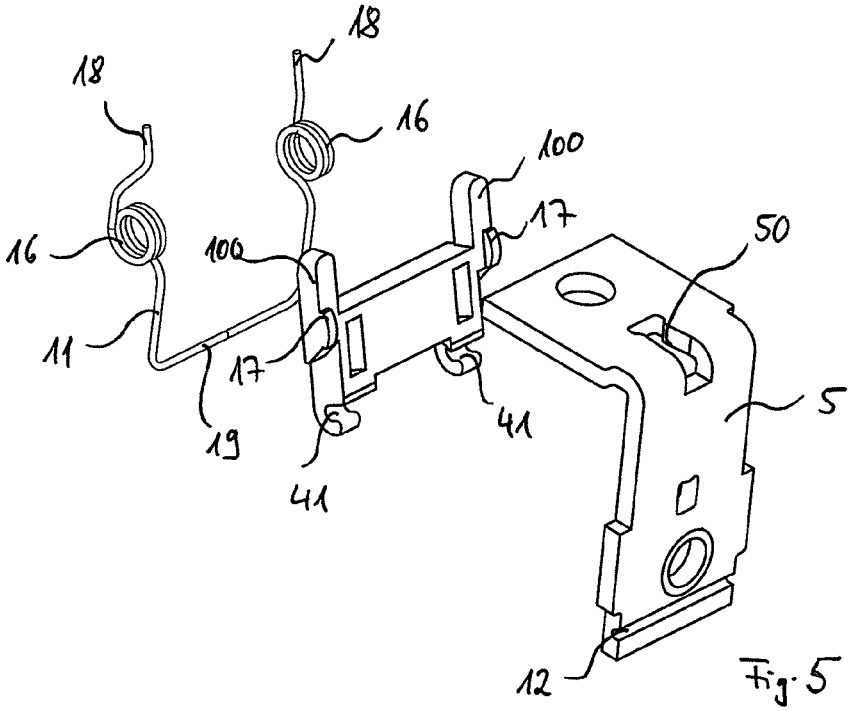
FIG. 5: shows an exploded representation of the pressure trip unit in FIG. 4.

FIG. 4 shows a perspective view of the pressure trip unit 9 from FIGS. 1 to 3 arranged on the main busbar 5, while FIG. 5 shows an exploded representation of the pressure trip unit 9 from FIG. 4. The pressure trip unit 9 comprises the pivoting gate 10 and a double torsion spring 32. The torsion spring 32 comprises two free ends 18, a centre limb 19, and torsion spring windings 16 configured between the free ends 18 and the centre limb 19. By means of the double torsion spring 32, the gate 10 can be arranged to pivot on the main busbar 5, wherein the main busbar, on the side thereof which is averted from the gate 10, incorporates a corresponding bearing slot 12, with which the centre limb 19 of the double torsion spring 32 engages. By means of a bearing rod 40, which functions as a pivoting axis X, which passes through the torsion spring windings 16 and is accommodated in corresponding recesses 41 in the gate 10, the double torsion spring 32 is arranged to pivot on the gate 10. The gate 10 incorporates two lugs 17 with which, in the service position, the free ends 18 of the double torsion spring 32 cooperate.

With the gate 10 in the home position, as represented in an exemplary manner in FIG. 2, the gate 10, under the influence of the double torsion spring 32, is pivoted away from the main busbar 5. A pressure threshold value can be set by means of the spring constant of the double torsion spring 32. Provided that an overpressure is applied to the gate 10 which lies below the pressure threshold value, the gate 10 is maintained in its home position by the force of the double torsion spring 32. Conversely, as soon as the pressure transmitted from the arc chute and acting on the gate 10 exceeds the pressure threshold value, the gate 10 overcomes the spring forces of the double torsion spring 32, and is pivoted from the home position to the tripping position, as represented in FIG. 3, whereby, in the above-mentioned manner, as a result of the interaction between the tripping lugs 100 of the gate 10 which are routed laterally to the main busbar and the tripping rod 60 of the trip mechanism 6, the power circuit-breaker 1 is tripped. Further to the completion of tripping, and the associated pressure drop in the arc chute, the double torsion spring 32 ensures that the gate 10 is restored to its home position, as represented in FIG. 2, and is thus available for a further tripping sequence.

Figure 6:
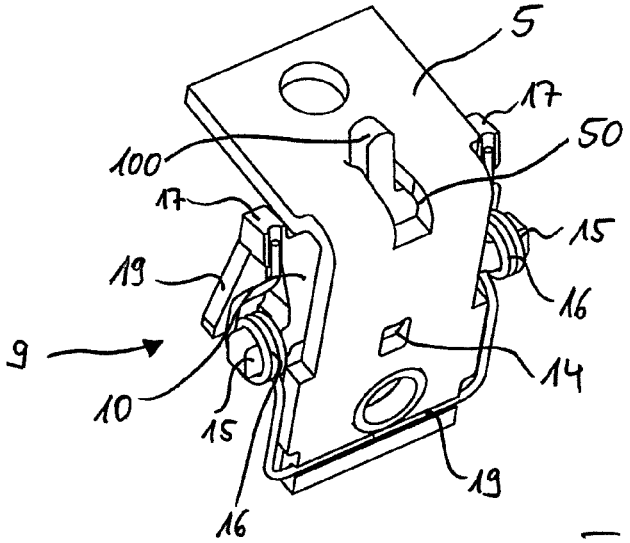
FIG. 6: shows a perspective view of the pressure trip unit arranged on a main busbar, according to a second form of embodiment.
Figure 7:
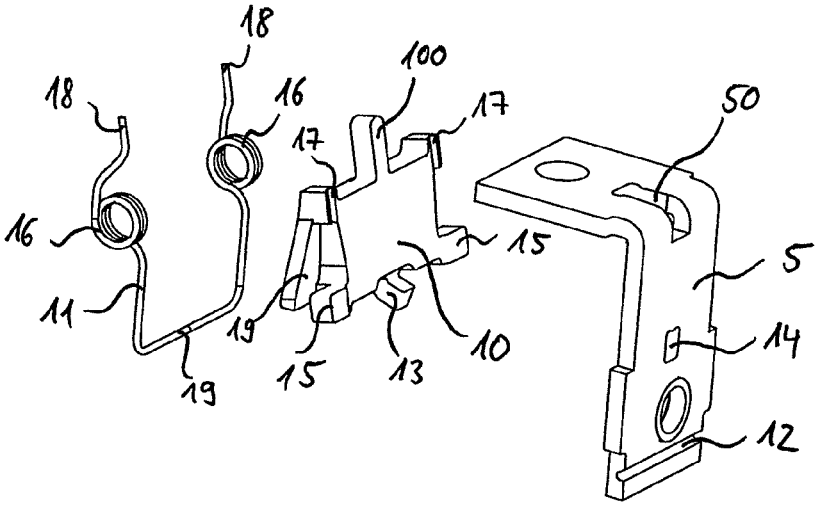
FIG. 7: shows an exploded representation of the pressure trip unit in FIG. 6.
Figure 8:
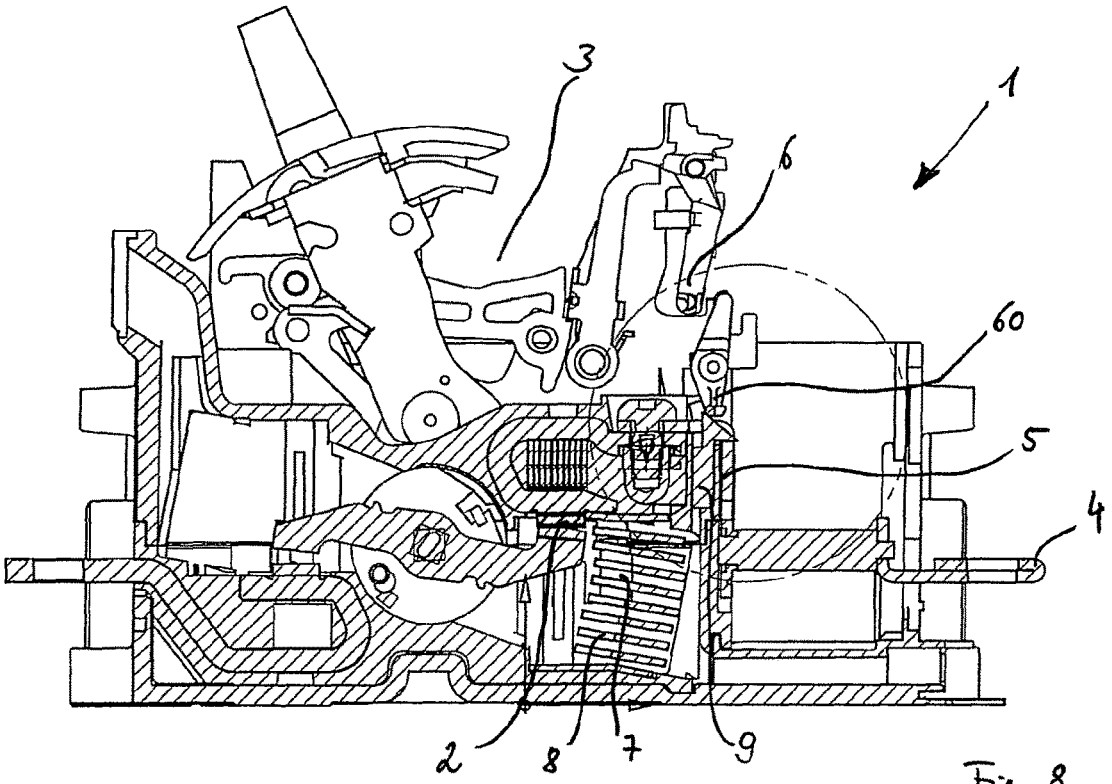
FIG. 8: shows a longitudinal section of a third form of embodiment of a power circuit-breaker according to the invention.

FIG. 6 shows a perspective view of a pressure trip unit 9, in a second form of embodiment, arranged on the main busbar 5, while FIG. 7 shows an exploded representation of the pressure trip unit 9 from FIG. 6. The pressure trip unit 9 comprises the pivoting gate 10 and a double torsion spring 32. The torsion spring 32 comprises two free ends 18, a centre limb 19, and torsion spring windings 16 configured between the free ends 18 and the centre limb 19. By means of the double torsion spring 32, the gate 10 can be arranged to pivot on the main busbar 5, wherein the main busbar, on the side thereof which is averted from the gate 10, incorporates a corresponding bearing slot 12, with which the centre limb 19 of the double torsion spring 32 engages. The gate 10, on the opposing end thereof to the tripping lugs 100, incorporates a centrally-arranged bearing pin 13 which, with the pressure trip unit 9 in the service position, engages with a recess 14 in the main busbar 5. The gate 10 further incorporates two laterally-spaced locating pins 15 with which, in the service position of the pressure trip unit 9, one of the two torsion spring windings 16 of the torsion spring 32 engages respectively. At the level of the tripping lug 100, and laterally spaced from the latter, the gate 10 incorporates two lugs 17 with which, in the service position, the free ends 18 of the double torsion spring 32 cooperate. Originating from the lugs 17, on either side of the gate 10, laterally-spaced and essentially triangular shielding elements 33 extend which, in the service position of the pressure trip unit 9, cover the torsion spring windings 16, thereby protecting the latter against the influx of gases from the arc chute 7.

With the gate 10 in the home position, as represented in an exemplary manner in FIG. 2, the gate 10, under the influence of the double torsion spring 32, is pivoted away from the main busbar 5. A pressure threshold value can be set by means of the spring constant of the double torsion spring 32. Provided that an overpressure is applied to the gate 10 which lies below the pressure threshold value, the gate 10 is maintained in its home position by the force of the double torsion spring 32. Conversely, as soon as the pressure transmitted from the arc chute and acting on the gate 10 exceeds the pressure threshold value, the gate 10 overcomes the spring forces of the double torsion spring 32, and is pivoted from the home position to the tripping position, as represented in FIG. 3, whereby, in the above-mentioned manner, as a result of the interaction between the tripping lugs 100 of the gate 10 which project through a guide slot 50 in the main busbar 5 and the tripping rod 60 of the trip mechanism 6, the power circuit-breaker 1 is tripped. Further to the completion of tripping, and the associated pressure drop in the arc chute, the double torsion spring 32 ensures that the gate 10 is restored to its home position, as represented in FIG. 2, and is thus available for a further tripping sequence.

FIGS. 8 to 11 show a third embodiment of the power circuit-breaker 1 according to the invention. Identical components are identified by the same reference symbols and, in the interests of the avoidance of repetitions, will not be the subject of any further separate description. The power circuit-breaker 1 according to FIG. 8 only differs from the power circuit-breaker 1 according to FIG. 1 with respect to the configuration of the pressure trip unit 9.

In the pressure trip unit 9 according to the third exemplary embodiment, the actuating element is configured as a laterally movable piston 20, which is accommodated in a housing 21. As can be seen from the exploded representation in FIG. 11, the housing 21 incorporates an upper opening 26, through which the piston 20 can be inserted in the housing 21. By means of two guide elements 24, the housing 21 encompasses the main busbar 5, as can be seen from FIG. 10. The base of the housing 21, which is not visible here, and is identified by the reference number 25, incorporates a plurality of openings. The housing 21, and the base thereof 25, are arranged directly adjacently to the arc chute 7, c.f. here also FIG. 9. Through these openings, in the service position of the pressure trip unit 9, the overpressure which is generated in the arc chute is propagated into the housing 21, and acts on the underside 27 of the piston 20. The piston 20 incorporates lateral guide webs 28, which cooperate with the inner side walls 29 of the housing 21, and by means of which the piston 20 is only movable within the housing 21 in the direction indicated by the double-headed arrow K. Adjacently to the guide webs 28, the piston 20 incorporates domes 22, onto which the return elements, configured here as helical compression springs 23, can be fitted. In the service position of the pressure trip unit 9, the helical compression springs 23 cooperate at one end 30 with the piston 20, whereas they engage, at their other end 31, with the main busbar 5. A pressure threshold value can be set by means of the spring constant of the helical compression springs 23. Provided that an overpressure is applied to the piston 20 which lies below the pressure threshold value, the piston 20 is maintained in its home position represented in FIG. 9 by the force of the helical compression springs 23. Conversely, as soon as the pressure transmitted from the arc chute and acting on the piston 20 exceeds the pressure threshold value, the piston 20 overcomes the spring forces of the helical compression springs 23, and moves within the housing 21, in the direction indicated by the arrow P in FIG. 9, from the home position to the tripping position, which is not represented separately here.

Figure 9:
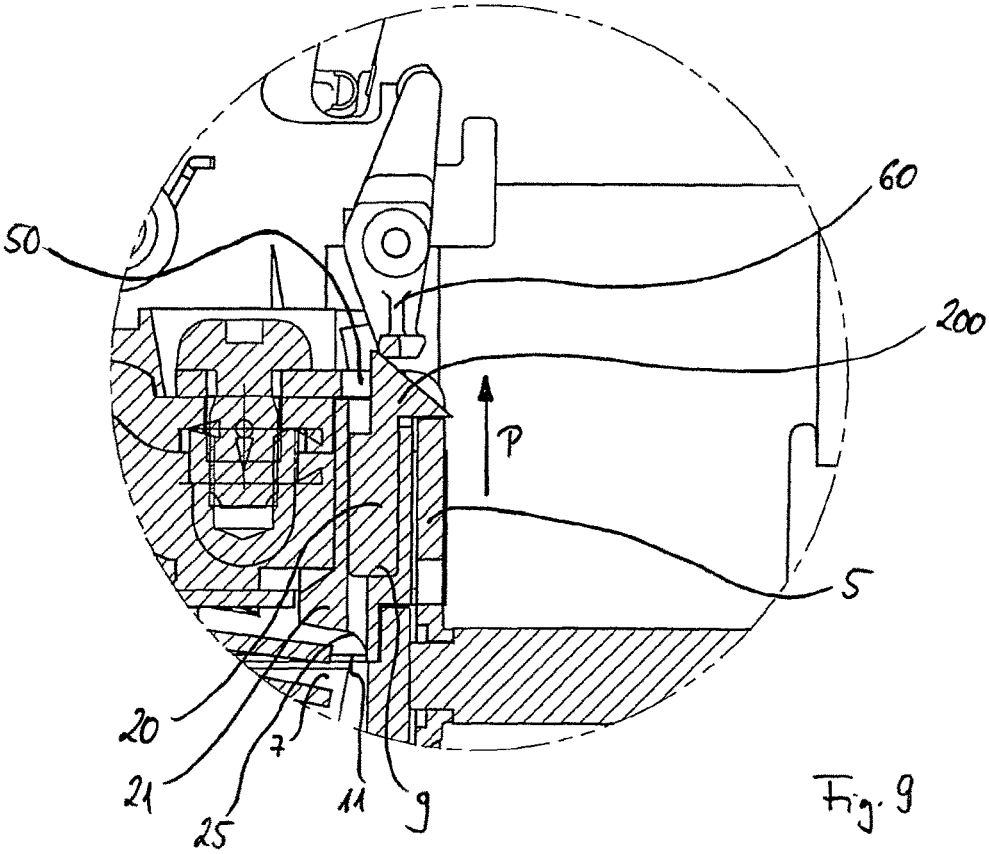
FIG. 9: shows an enlarged representation of a section of FIG. 8, with the actuating element in the home position.
Figure 10:
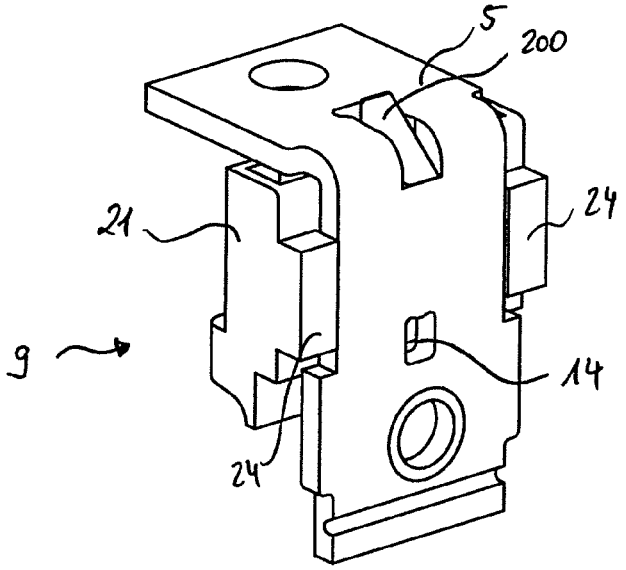
FIG. 10: shows a perspective view of the pressure trip unit arranged on a main busbar, according to the third form of embodiment.
Figure 11:
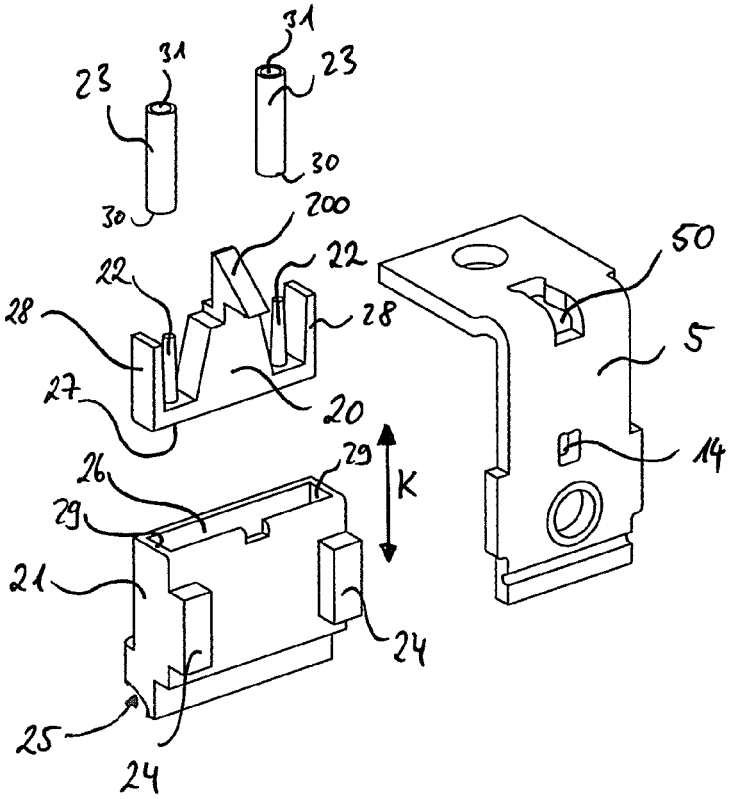
FIG. 11: shows an exploded representation of the pressure trip unit in FIG. 10.

On the end thereof arranged opposite the underside 27, the piston 20 incorporates a tripping lug 200 which, in the service position, mechanically engages with the trip mechanism 6 through the guide slot 50 in the main busbar 5. At its free end, as can clearly be seen from FIG. 11, the tripping lug 200 is tapered. Upon the transition of the piston 20 from the home position to the tripping position, the linear motion of the piston, as a result of the taper of the tripping lug 200, initiates a rotating motion of the tripping rod 60 which is associated with the trip mechanism 6 and cooperates with the tripping lug 200. As a result of this interaction between the tripping lug 200 and the tripping rod 60 of the trip mechanism 6, the power circuit-breaker 1 is tripped. Further to the completion of tripping, and the associated pressure drop in the arc chute, the helical compression springs 23 ensure that the piston 20 is restored to its home position, as represented in FIG. 9, and is thus available for a further tripping sequence.

By the arrangement of the pressure trip unit 9 directly adjacently to the arc chute 7, a power circuit-breaker 1 is provided according to an embodiment of the invention which, in comparison with known solutions, responds virtually instantaneously.

Moreover, the pressure trip units 9 according to the first, second and third exemplary embodiments described require the same space with in the power circuit-breaker 1, and employ the same interfaces. Thus, in a given power circuit-breaker 1, a simple changeover from a pressure trip unit 9 configured with a movable piston 20 to a pressure trip unit 9 configured with a pivoting gate 10, and vice versa, is possible. Finally, the pressure trip units 9 also occupy the same space as the hinged armature of the instantaneous short-circuit trip device described in DE 202 14 922 U1 such that, here again, according to the requisite response behaviour of the power circuit-breaker, a very simple changeover from a system with instantaneous short-circuit trip devices to a system with pressure trip units, and vice versa, is possible, wherein, in addition, no further modifications to the basic power circuit-breaker employed are required. By means of the power circuit-breaker according to an embodiment of the invention, in combination with instantaneous electromagnetic short-circuit trip devices, a modular system is provided which can be adapted to different requirements in a highly flexible manner, with no major modifications.

Given that, according to an embodiment of the present invention, a dedicated pressure trip unit 9 is assigned to each pole of the power circuit-breaker 1, a transition from a multi-pole system to a single-pole system, and vice versa, is also possible, with no additional measures.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A single- or multi-pole power circuit-breaker, comprising, for each pole:

main contacts;

overload- and/or short-circuit current-actuated tripping means;

an actuating mechanism configured to open and close the main contacts;

an arc chute; and a pressure trip unit having a return element and an actuating element responsive to an overpressure in the arc chute, wherein tripping of the power circuit-breaker by a trip mechanism is executable both by the tripping means and by the pressure trip unit, wherein the pressure trip unit is arranged immediately adjacently to both the arc chute and to a main busbar which is routed to the main contacts, and is arranged within a closed pressure chamber which is connected to the arc chute, wherein at least one tripping lug which projects from the actuating element is configured to mechanically engage with the trip mechanism such that the overpressure in the arc chute associated with a generation of an arc between the main contacts is transmitted virtually instantaneously to the pressure chamber, where the overpressure acts on the actuating element of the pressure trip unit, wherein the actuating element is configured to switch over directly from a home position to a tripping position, against a force of the return element, in a case of overshoot of a pressure threshold value which is set by the return element, wherein the actuating element comprises a gate which is arranged to pivot about a pivoting axis, and wherein the gate, in the home position, under influence of the return element, is pivotable away from the main busbar and, in the case of the overshoot of the pressure threshold value, against the force of the return element, is pivotable out of the home position towards the main busbar.

2. The single- or multi-pole power circuit-breaker according to claim 1, wherein the return element comprises at least one spring.

3. The single- or multi-pole power circuit-breaker according to claim 1, wherein the actuating element comprises a linearly movable piston.

4. The single- or multi-pole power circuit-breaker according to claim 3, wherein the pressure trip unit comprises a housing, in which the piston is accommodated, wherein a base of the housing which faces the arc chute includes at least one opening, through which the overpressure which is generatable in the arc chute is propagated into the housing, and acts on the piston.

5. The single- or multi-pole power circuit-breaker according to claim 3, wherein the at least one tripping lug projects from the piston and is configured to mechanically engage with the trip mechanism, the at least one tripping lug being tapered at a free end such that a linear motion of the piston initiates a rotary motion of a tripping rod which is associated with the trip mechanism and which cooperates with the free end of the at least one tripping lug.

6. A modular system, comprising:

the single- or multi-pole power circuit-breaker according to claim 1; and instantaneous electromagnetic short-circuit trip devices, wherein, for each pole of the power circuit-breaker, the pressure trip unit is interchangeable with the instantaneous electromagnetic short-circuit trip device which occupies a same space and employs one or more same interfaces.

7. The modular system according to claim 6, wherein the return element is employed for both the pressure trip unit and the instantaneous short-circuit trip device.

8. The modular system according to claim 6, wherein the gate of the pressure trip unit and a magnetic armature of the instantaneous short-circuit trip device essentially comprise a same angle of rotation and occupy essentially a same position within the power circuit-breaker.

9. The modular system according to claim 6, wherein the at least one tripping lug configured on the gate and the tripping lug configured on a magnetic armature of the instantaneous short-circuit trip device are of identical design such that, in a case of rotary motion of the gate or the magnetic armature, a load is applied to a tripping rod associated with the trip mechanism in a same manner.

10. The modular system according to claim 6, wherein, for both the pressure trip unit and the instantaneous short-circuit trip device, a tripping rod, associated with the trip mechanism, of identical design is employed.

11. A modular system, comprising:

the single- or multi-pole power circuit-breaker according to claim 1; and instantaneous electromagnetic short-circuit trip devices, wherein, for each pole of the power circuit-breaker, the pressure trip unit is interchangeable with the instantaneous electromagnetic short-circuit trip device which occupies a same space and employs one or more same interfaces.

12. A single- or multi-pole power circuit-breaker, comprising, for each pole:

main contacts;

overload- and/or short-circuit current-actuated tripping means;

an actuating mechanism configured to open and close the main contacts;

an arc chute; and a pressure trip unit having a return element and an actuating element responsive to an overpressure in the arc chute, wherein tripping of the power circuit-breaker by a trip mechanism is executable both by the tripping means and by the pressure trip unit, wherein the pressure trip unit is arranged immediately adjacently to both the arc chute and to a main busbar which is routed to the main contacts, and is arranged within a closed pressure chamber which is connected to the arc chute, wherein at least one tripping lug which projects from the actuating element is configured to mechanically engage with the trip mechanism such that the overpressure in the arc chute associated with a generation of an arc between the main contacts is transmitted virtually instantaneously to the pressure chamber, where the overpressure acts on the actuating element of the pressure trip unit, wherein the actuating element is configured to switch over directly from a home position to a tripping position, against a force of the return element, in a case of overshoot of a pressure threshold value which is set by the return element, wherein the actuating element comprises a gate which is arranged to pivot about a pivoting axis, and wherein the gate includes laterally-projecting shielding elements which, with the pressure trip unit in a service position, at least partially cover the return element.

13. A single- or multi-pole power circuit-breaker, comprising, for each pole:

main contacts;

overload- and/or short-circuit current-actuated tripping means;

an actuating mechanism configured to open and close the main contacts;

an arc chute; and a pressure trip unit having a return element and an actuating element responsive to an overpressure in the arc chute, wherein tripping of the power circuit-breaker by a trip mechanism is executable both by the tripping means and by the pressure trip unit, wherein the pressure trip unit is arranged immediately adjacently to both the arc chute and to a main busbar which is routed to the main contacts, and is arranged within a closed pressure chamber which is connected to the arc chute, wherein at least one tripping lug which projects from the actuating element is configured to mechanically engage with the trip mechanism such that the overpressure in the arc chute associated with a generation of an arc between the main contacts is transmitted virtually instantaneously to the pressure chamber, where the overpressure acts on the actuating element of the pressure trip unit, wherein the actuating element is configured to switch over directly from a home position to a tripping position, against a force of the return element, in a case of overshoot of a pressure threshold value which is set by the return element, and wherein the actuating element comprises a gate which is arranged to pivot about a pivoting axis, further comprising at least one sealing element arranged in the pressure chamber, wherein the gate, in a case of transition from the home position to the tripping position, is permanently sealed with respect to the at least one sealing element.

14. The single- or multi-pole power circuit-breaker according to claim 13, wherein a projection is configured on the gate which, in the case of the transition of the gate from the home position to the tripping position, is configured to move along a circular outline of at least one sealing element and remain in an overlapping arrangement with the at least one sealing element.

* * * * *